United States Patent [19]

Havstad

[11] 4,416,270

[45] Nov. 22, 1983

[54] PERCUSSOR

[75] Inventor: Harold R. Havstad, Eagle Point, Oreg.

[73] Assignee: Hudson Oxygen Therapy Sales Company, Temecula, Calif.

[21] Appl. No.: 207,468

[22] Filed: Nov. 17, 1980

Related U.S. Application Data

[63] Continuation of Ser. No. 50,685, Jun. 21, 1979, abandoned.

[51] Int. Cl.[3] ..... A61H 7/00

[52] U.S. Cl. ..... 128/53

[58] Field of Search ..... 128/38, 40, 50, 53, 128/55, 64, 65, 67; 91/403, 410, 432

[56] References Cited

U.S. PATENT DOCUMENTS

| | | | |
|---|---|---|---|
| 1,780,876 | 11/1930 | Grosse | 128/64 |
| 2,052,098 | 8/1925 | Lockett | 128/40 |
| 2,646,039 | 7/1953 | Agosti | 128/64 |
| 3,396,721 | 8/1968 | Mencacci | 128/64 |
| 3,720,204 | 3/1973 | Wojtowicz | 128/64 |

FOREIGN PATENT DOCUMENTS

| | | | |
|---|---|---|---|
| 488311 | 9/1918 | France | 128/53 |
| 344986 | 3/1931 | United Kingdom | 128/53 |

*Primary Examiner*—Richard J. Apley
*Assistant Examiner*—David J. Brown
*Attorney, Agent, or Firm*—Seiler & Quirk

[57] ABSTRACT

An improved percussor comprises an oscillating assembly having a reciprocating plunger, a first and second chamber and a gas tight seal therebetween when the plunger is at rest in a biased position, and gas inlet means for directing gas into the first chamber to begin to force the plunger downwardly against the biasing force, thereby unseating the gas seal between the chambers. The gas pressurizes the second chamber to force the plunger to a second position and the pressure is then relieved through a gas exit passageway. In response to the pressure drop, the plunger is returned to its original position. This plunger reciprocation is repeated rapidly to achieve the percussor action. In a preferred embodiment, a fluid containing chamber having exteriorly exposed fluid impermeable membrane engages the reciprocating plunger whereby the energy is directed through the liquid and membrane.

8 Claims, 5 Drawing Figures

PERCUSSOR

This is a continuation of application Ser. No. 50,685 filed June 21, 1979 abandoned.

BACKGROUND OF THE INVENTION

The use of a percussor as an effective device in physical and respiratory therapy is well recognized. A percussor generally has a reciprocating plunger with a rubber cup or similar resilient device at one end which is held against the patient in the area of the body to be treated. Such a device is often used as an alternative or substitute for manual percussion, in which a therapist uses his or her hands against the patient's body in a clapping manner. Percussive devices are shown, for example, in U.S. Pat. Nos. 1,516,717 and 1,796,444. In respiratory therapy, the percussor is held against the patient's chest to mobilize fluids which have accumulated in the lungs. Such a device is effectively used in treatment of bronchitis and similar lung disorders in which desirable treatment is to assist the patient in coughing up and expectorating fluids and mucus.

A percussor for the treatment of cystic fibrosis has been shown to be useful, such a device being disclosed in U.S. Pat. No. 3,955,563. A stated advantage of the latter device over those of the earlier state of the art percussors is the elimination of the straight mechanical linkage vibration features, which have been indicated as causing injury, especially to children, or other users having rather delicate or fragile bone structure, particularly around the ribs. Although the percussor disclosed utilizes a pneumatic powered plunger, rather expensive electronic or fluidic control valves are incorporated for controlling the rate of air bursts to the plunger to achieve the reciprocating percussor motion.

SUMMARY OF THE INVENTION

It is an object of the present invention to provide a percussive device which more accurately simulates or duplicates manual percussion, while providing more consistant and regular clapping rhythm, and obviating therapist fatigue. It is also an object to provide a pneumatic percussor which does not require electronic or fluidic control valves for operation. The percussor of the present invention comprises an oscillating assembly incorporating a reciprocating plate and two chambers into which gas is introduced for moving the assembly. When the plate is in a biased rest position, a gas tight seal is formed between the two chambers. By introducing gas into a first one of the chambers the plate is urged against the force of the bias until the gas tight seal is broken, whereby the gas rushes into the second chamber and forces the plate substantially as the surface area of the plate is exposed to increased pressure in the second chamber. The gas pressure in the second chamber is then relieved whereupon the plate is returned to its original or rest position by the biasing means. This sequence is repeated rapidly to achieve the percussion effect. In a preferred embodiment, the force of the plate is transmitted through a gas or liquid containing chamber and an exteriorly exposed flexible membrane. More detailed features as well as the advantages of the percussor of the invention will be evident from the following detailed description.

DETAILED DESCRIPTION OF THE INVENTION

Figure 1:
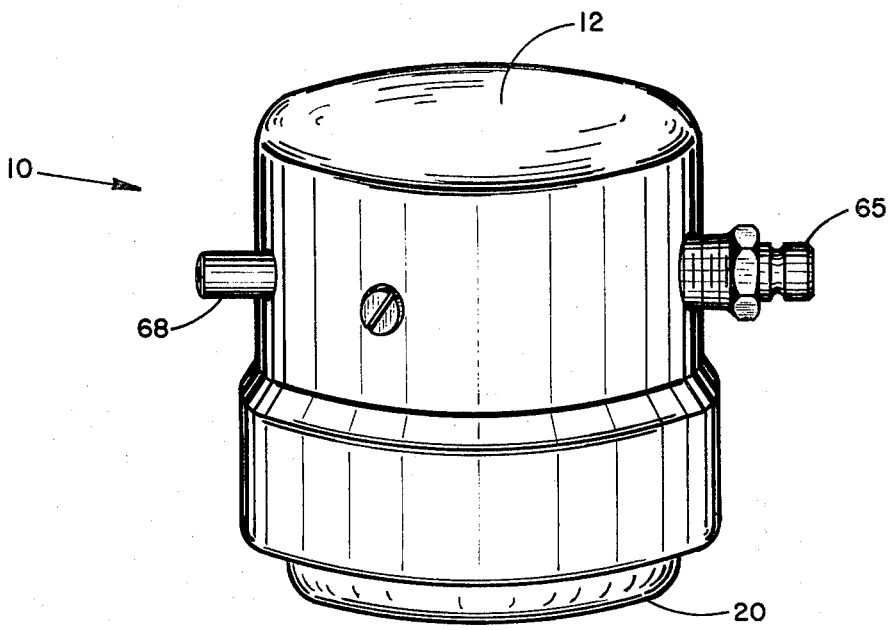
FIG. 1 is a perspective view of a percussor of the invention.
Figure 2:
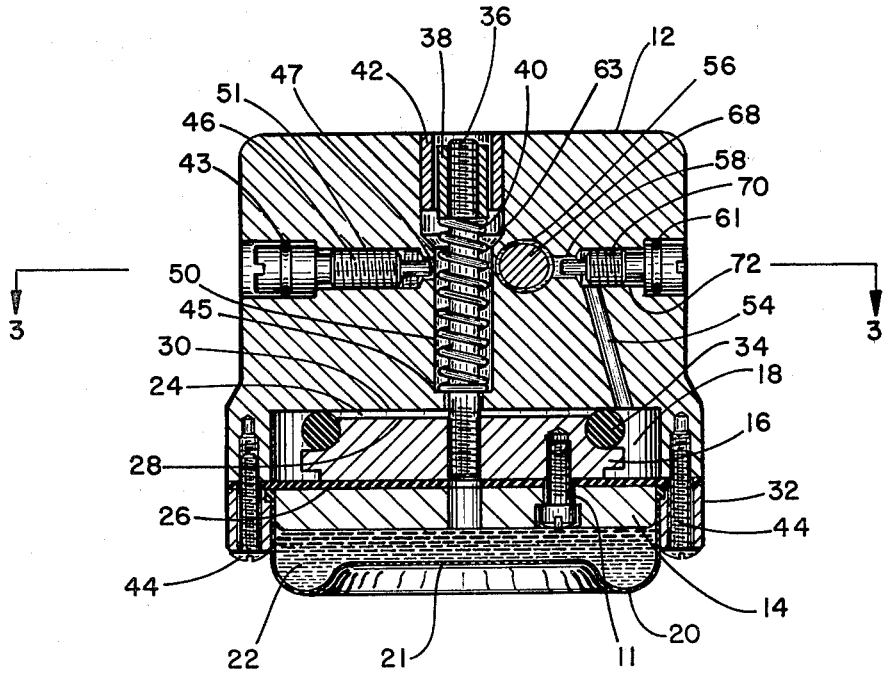
FIG. 2 is a side sectional elevation of the percussor taken along lines 2—2 of FIG. 3.
Figure 3:
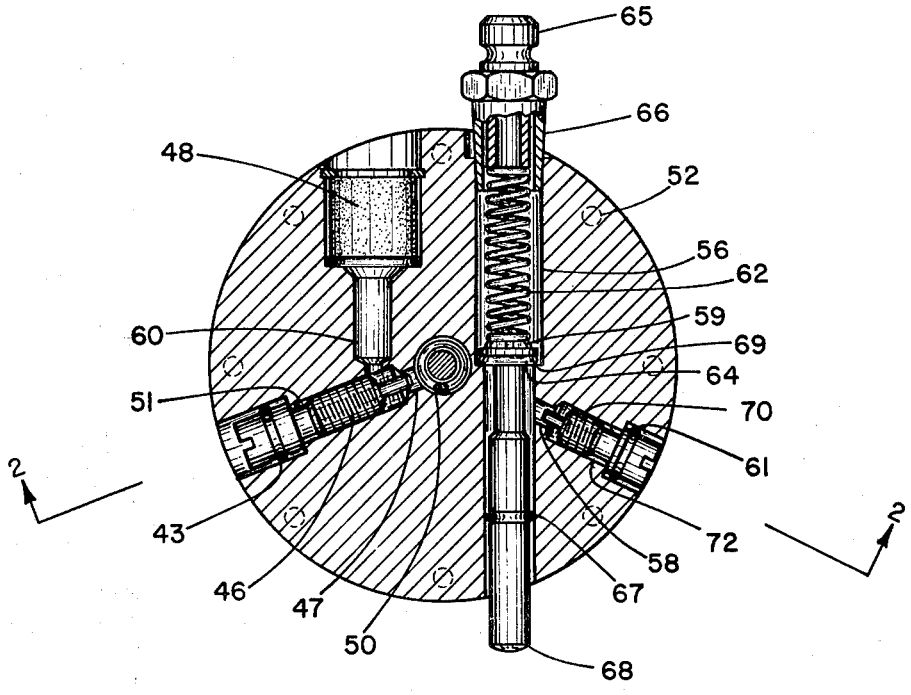
FIG. 3 is a sectional view taken along lines 3—3 of FIG. 2.

In FIGS. 1–3 there is shown generally the percussor 10 comprising a body member 12 having extending therefrom a gas inlet pipe 66 and gas outlet port 48. A gas-on button or valve 68, which may be actuated by a user, is also conveniently located on the body member for easy access. On the bottom of the device, according to the preferred embodiment, is a flexible membrane 20 which defines or encloses a fluid containing chamber. According to that embodiment, the energy from a rapidly reciprocating plunger is directed through the fluid filled chamber, and the membrane is held against the patient's body as the device is used and operated.

An important aspect of the percussor of the invention is the manner in which the device achieves the rapid percussive effect. In the present device, an oscillating assembly is moved reciprocally or upwardly and downwardly in an alternative manner, as a second gas-filled chamber is alternately expanded and contracted. The assembly is biased toward a position at which the second gas chamber is contracted or at its smallest volume. Gas is directed into a first chamber at sufficient pressure to overcome a gas tight seal between it and the second chamber. Once the seal is broken or opened, the increasing gas pressure in the second chamber forces the assembly to move downwardly against the bias. The gas is then directed outwardly from the chamber or "dumped" which allows the assembly to be returned to its original position by the biasing means. This sequence is repeated continuously and rapidly to achieve the percussive effect.

In the device of the invention, the second chamber is open to atmosphere through a restrictive port or passageway. However, once the gas seal between the chambers is opened, the gas is directed into the second chamber from the first chamber and then evacuated from the second chamber at a greater rate than gas flow into the first chamber, to allow for rapid pressure reduction in the chambers and return of the oscillating assembly. Operation of the apparatus of the invention will be explained in greater detail by referring to the drawings.

As shown in FIGS. 2 and 3, within body member 12 are passageways 56, 58 and 54 for introducing gas into the chambers, and gas outlet passageways 50, 47 and 60. The gas inlet passageways are in successive communication for directing the gas into the device from gas connector 65 which is secured to a suitable gas supply source. Similarly, the gas outlet passageways are successively in communication, and the direction of gas therethrough will be explained hereinafter. Where the body member is of solid construction, these passageways may be drilled or otherwise formed into the device in any suitable manner. The body member also may be molded, and partially hollow, depending on the mass or other structural characteristics desired. So that energy from the reciprocating plunger will not be primarily directed upwardly through the percussor body to the hand and arm of the person administering the percussive treatment, the body mass is preferably substantial, such as would be achieved utilizing a more solid body member. Accordingly, the body is preferably made of aluminum or material having similar density and mass characteristics. The exterior body shape is not critical, but is formed for conveniently being held in a person's hand.

The oscillating assembly comprises a plunger 14 and reciprocating plate 16 between which is secured a diaphragm 26. The plate and plunger are held together securely by a plurality of screws 11, although any other suitable securing means may be used. Diaphragm 26 is flexible and provides gas and liquid sealing between chambers on both sides of the diaphragm. Moreover, because of the flexibility of the diaphragm, the plunger and plate can move reciprocally and independently of body member 12.

The diaphragm is shown extending fully between the plunger and reciprocating plate. However, other diaphragm, plunger and plate designs or shapes may be used. For example, the diaphragm could be vulcanized to the plunger or plate. The plunger and plate may then be abutting, or even formed in a single piece. The outside edge or periphery of the diaphragm, which is circular or otherwise conforms to the general outside shape of the body member is secured to the body member by a diaphragm retention plate 32. Thus, the diaphragm is sandwiched between the retention plate and the body member, and bolt 44 extending through bolt shaft 52 threadedly engages the diaphragm retention plate. The upper end of the bolt shafts are enlarged to accommodate the bolt head and form a shoulder for stationing the bolt so that it can be tightened to secure the diaphragm.

The oscillating assembly is biased upwardly by spring 40 which may be received in gas outlet passageway 50. The lower end of the spring is forced against shoulder 45 while the upper end is biased against spring retaining nut 38 which threadedly engages post 36. The lower end of the post threadedly engages reciprocating plate 16, so that the spring, attempting to expand along the axis of post or shaft 36, urges spring retaining nut 38, post 36 and the plate and plunger upwardly.

Gas accumulation chamber 18 is conveniently formed in the body member and is in communication with the third gas inlet passageway 54. Second gas chamber 24 is defined between a lower body surface 30 and upper or top surface 28 of plate 16. An O-ring 34 or similar seal forms a gas tight seal between chambers 18 and 24 when the plate and plunger are in their rest position whereby chamber 24 is fully contracted. It is only when the gas pressure in gas accumulation chamber 18 reaches threshold pressure that the gas tight seal, formed by O-ring urged against bottom surface 30 of the body member, is broken, whereupon gas accumulated in chamber 18 expands rapidly into chamber 24. The exposure of a substantial surface area 28 of plate 16 to the increased pressure in the second chamber then results in the plate and plunger being forced downwardly, as the pressure overcomes the bias force.

In a preferred embodiment, a fluid filled chamber is used for directing or transferring the energy from the reciprocating plunger 14 to a user or patient. In the device shown, a chamber 21 is filled with fluid 22 which is held in the chamber by a flexible and fluid impermeable membrane 20. The membrane is secured around its peripheral edge between diaphragm 26 and the diaphragm retention plate 32. The edge of the membrane, normally circular in shape, similar to that of diaphragm 26, is sandwiched between the diaphragm and diaphragm retention plate, the latter tightened for sealing engagement by bolts 44. Fluid 22 in chamber 21 is exposed to plunger 14 so that the reciprocating motion of the plunger is transferred directly to the fluid and membrane, the outer exposed surface of which is placed against the patient's body to achieve the percussive effect of the device during operation Alternative to the fluid exposure to the plunger, the liquid chamber may be enclosed entirely in a sack structure, such as being fully encased in a flexible membrane, which is secured to the device, against plunger 14. Other similar embodiments may be used. The fluid used in the fluid holding chamber may be any non-corrosive fluid material, especially that which will not cause injury, burns, irritations, etc. if contacting any part of the patient. Although water is acceptable, because of problems of bacterial growth or other contamination, synthetic materials such as silicone fluids, silicones or other non-toxic liquids may be used. Chamber 21 may alternatively be filled with gas, in which case the membrane and chamber must be sealed to retain adequate gas pressure therein to transfer sufficient plunger force to the outer membrane surface for percussor therapy.

To introduce gas into the device for operation, a off-on valve, preferably one which may be easily held in an "on" position by the user when the device is held in the hand, is conveniently located on the device. In the apparatus shown, a protruding valve extension 68 is biased in the closed position shown in FIG. 3. With a pressurized gas supply source connected at gas connector 65, biasing spring 62, located in first gas inlet passageway 56, is forced against the end of the valve in the form of screw head 59, or similar plate surface, which forces gasket 64 against valve seat 69, thereby forming a gas-tight seal to normally prevent the pressurized gas from entering the device. Alternatively, an external, manually operated valve, such as a needle valve, regulator valve, or simply an on-off valve, may be used.

When it is desired to initiate percussor operation, an operator simply presses against valve extension 68, thereby forcing the valve body or spool against the bias of spring 62, unseating gasket 64 so that the pressurized gas can enter gas inlet line 66 and pass successively through first, second, and third gas inlet passageways 56, 58 and 54, respectively. Since third gas inlet passageway 54 communicates directly with gas accumulation chamber 18, pressurized gas enters that chamber. With the valve held in the open position, the gas continues to pressurize gas accumulation chamber 18 until sufficient pressure has built up to move plunger 14 and oscillating plate 16 downwardly against the force of the bias spring 40. It will be understood that chamber 18 is gas sealed with gas impermeable diaphragm 26 on one side and gas sealing O-ring 34 on the other, the chamber being otherwise defined between the side of plate 16 and the interior surface of body member 12, as shown. With the gas pressure initially forcing the plunger and plate downwardly, gas sealing O-ring 34, which is secured on the plate, is unseated from its sealing engagement with body surface 30 thereby allowing the gas to expand into second chamber 24. With this rapid pressurization of the second chamber, the plate and plunger are forced further downwardly because of the substantial area of surface 28 exposed to the pressurized chamber. In designing the device, maximum exposure of the reciprocating plate or other reciprocating assembly surface to the second chamber and the smallest effective chamber volume, may be desired, to reduce operating gas requirement. The extent of downward travel of the plate and plunger will depend on the strength of biasing spring 40, the gas pressure in chamber 24, and the limitation of plunger travel otherwise built into the device. For example, shoulder 63 may act as a stop for travel of spring retaining nut 38 or other portion of the downwardly travelling nut, post 36 or the like.

Following rapid pressurization of second chamber 24 and resulting movement of the oscillating assembly as above described, gas pressure in the second chamber is relieved because the chamber is open to atmosphere through a restricted passageway system. As the pressure is reduced, the bias of spring 40 reverses the travel of the plunger and plate and they are returned to their original or rest position. The gas pressure in chamber 24 is relieved through successive first, second and third gas outlet passageways 50, 47 and 60. The exhausted gas is simply dumped to atmosphere, preferably passing first through a sound muffling means such as a foam member 48, or the like. Although the gas outlet passageways are restricted, the rate at which the gas is evacuated from chamber 24 is greater than the rate of gas accumulation in first chamber 18. Thus, the outlet passageways are open sufficiently to provide for gas pressure release from chamber 24 more rapidly than gas inlet pressure to allow the biasing spring to return plunger and plate to the rest position. Although the gas outlet passageway sytem shown utilizes a cavity in which spring 40 and post 36 are located, as shown, instead, a separate gas outlet passageway may communicate with chamber 24.

The frequency of plunger reciprocation may be varied by incorporating means for regulating or limiting the rate of pressurizing the gas accumulation chamber rate of second chamber evacuation. In the embodiment shown, a needle valve 70 is provided between gas inlet passageways 58 and 54, which needle valve threadedly engages cavity 72 and is provided with gas sealing O-ring 61. Accordingly, the size of the passageway may be enlarged or restricted by adjusting the depth of the needle valve in the cavity. Although cavity 72 is shown as bridging between gas inlet passageways 58 and 54, and in which the gas restricting needle valve 70 is located, other means for regulating or varying the gas inlet flow may be used. By so regulating the incoming gas flow the rate at which chamber 18 will be pressurized to begin to move the plunger downwardly is determined. Thus, at a given rate for exhausting the gas from chamber 24, gas inlet rate increase causes the plunger to reciprocate more rapidly. However, such a valve or other variable inlet restriction means is optional.

The frequency of plunger reciprocation may also be varied by changing the gas evacuation or outlet rate. Accordingly, in a preferred embodiment, needle valve 46 is threadedly engaged in cavity 51 which extends across or between gas outlet passageways 47 and 60. Needle valve 46 is also supplied with a gas sealing O-ring 43, and by changing the depth of the needle valve in the cavity, the gas outlet passageway system may be varied, to select the rate at which gas is exhausted or evacuated from chamber 24. Other equivalent means for selecting gas exhaust rates may be used. The valve 46 or other flow restrictions may also be provided with conveniently exposed thumb wheel or similar adjustment features.

Although excess gas escapes from other than the gas inlet and gas outlet passageways is preferably avoided, some slight leakage may not be critical. For example, it is found that to avoid substantial frictional energy losses caused by reciprocating plunger assembly, a bushing 42 is slightly separated from the spring retention nut 38. The bushing not only serves to assist in the guidance of the reciprocating plunger and post, but also restricts the size of the space around the outside of the spring retention nut, thereby limiting gas leakage between those two components. However, other means for providing gas sealing of the reciprocating post or vibrator assembly may be used, so long as excessive friction is not created to adversely affect plunger reciprocation.

Although the apparatus has been disclosed as utilizing a liquid or gas containing chamber and flexible membrane for contacting the patient during a percussive treatment, other types of applicator means may be used, including pads or cups, or other devices secured to or cooperating with plunger 14. In addition, different means for directing gas from gas accumulation chamber 18 to expandable chamber 24, may be used, such as spring loaded, or pressure responsive valve means and the like. For example, one or more spring loaded valves opening at a predetermined gas pressure within chamber 18 may be used, the valves then opening to rapidly direct gas into chamber 28. One or more O-rings or other gas sealing means may also be secured to the oscillating assembly, i.e., plunger and/or plate, in place of the diaphragm and forming a gas-tight seal between the oscillating assembly, gas accumulation chamber, and exteriorly thereof, the device functioning otherwise as previously described.

Figure 4:
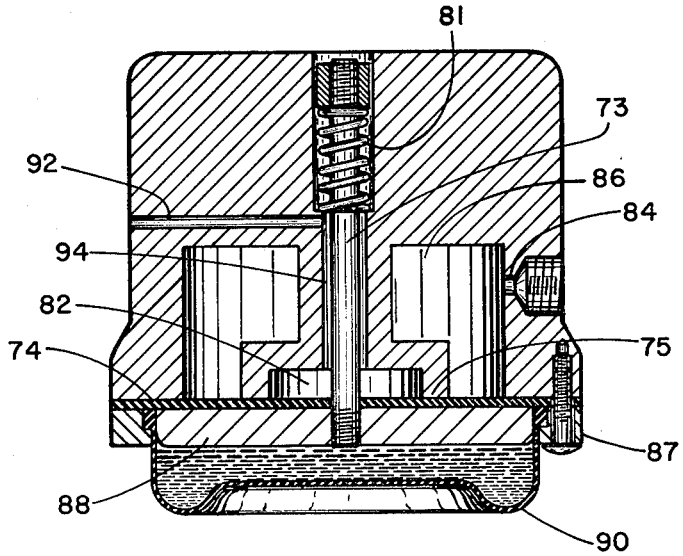
FIG. 4 is a side sectional view of another percussor embodiment of the invention.

In FIG. 4 there is illustrated a side sectional view of a percussor according to the invention utilizing a somewhat different and simplified oscillating assembly as compared to that previously described. In the percussor shown, a number of components are not shown for the sake of simplicity, but which are substantially like those previously described regarding FIGS. 2 and 3. In this embodiment, the oscillating assembly comprises a reciprocating plate 88 which lies against diaphragm 74. The oscillating assembly also includes post or rod 73, spring 81, and a spring retaining nut at the upper end of the rod substantially like that shown in FIG. 2. The lower end of rod 73 threadedly engages reciprocating plate 88, with spring 81 acting to urge rod 73 and plate 88 upwardly, thereby also urging diaphragm 74 against annular collar 75. The two chambers, gas accumulation chamber 86 and expandable chamber 82 are separated from one another by annular collar 75 and diaphragm 74, the latter being urged upwardly against the collar to form a gas-tight seal. The applicator means of the device is substantially like that previously described incorporating a flexible but fluid impermeable membrane 90 having therein a liquid which is acted upon a reciprocating plate 88.

The device functions as a percussor as pressurized gas is directed into gas accummulation chamber 86 via gas inlet passageway 84, which may also include a needle valve for regulating the rate of gas flow into chamber 86, and an on-off valve, which components are not shown, and may be substantially like those previously described regarding FIGS. 2 and 3. As the gas pressure builds sufficiently within gas accummulation chamber 86, it will force diaphragm 74 and plate 88 downwardly against the bias of spring 81. As the bias is overcome, gas will rush past the gas-tight seal formed by diaphragm 74 and collar 75 into the second expandable chamber 82, and exert additional pressure along the upper surface of diaphragm 74, thereby further forcing the diaphragm and reciprocating plate downwardly.

With chamber 82 open to gas outlet passageways 94 and 92, gas expanding into chamber 82 is vented out of the device, thereby allowing reduction of the pressure in chamber 82 to allow spring 81 to return the reciprocating plate and diaphragm to their original rest position, the diaphragm again forming a gas-tight seal with collar 75. This alternate expansion and contraction of chamber 82 as the gas-tight seal between the diaphragm and the collar is alternately opened and closed, causes reciprocating plate 88 to oscillate, which energy is transferred through the fluid to membrane 90, to achieve the percussive effect of the apparatus. A retaining clamp 87 is shown as an example of means for securing the membrane 90 to the upper body or housing of the percussor. The gas outlet passageway 92 may also be provided with a needle valve, or other means for varying the rate at which the gas is vented from chamber 82, in a manner previously described regarding FIGS. 2 and 3.

Figure 5:
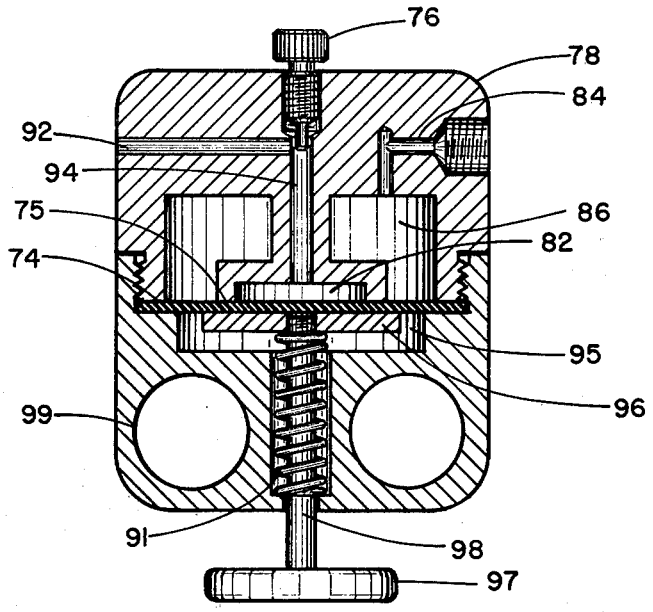
FIG. 5 is a side sectional view of still another embodiment of a percussor according to the invention.

Still another embodiment of the invention is shown in FIG. 5, in which the oscillating assembly incorporates the same means for providing a gas seal between the first and second chambers 86 and 82, respectively as shown in FIG. 4. Accordingly, reciprocating plate 96 lies against diaphragm 74, forming a gas-tight seal with collar 75, which separates the two chambers. In this embodiment, however, the rod 98 is secured to plate 96 by threaded engagement and extends downwardly, out of the percussor body. At the opposite rod end is an applicator 97, in the form of a pad, cup, or the like. Spring 91 urges reciprocating plate 96 upwardly against diaphragm 74, and the diaphragm against the collar 75. Gas inlet port 84 directs pressurized gas into gas accummulation chamber 86, and again, although not shown, the gas inlet means may include suitable needle valve and off-on valve means. When the operator connects and directs pressurized gas to the device, the gas enters passageway 84 and pressurizer chamber 86, until sufficient pressure urges the diaphragm and reciprocating plate downwardly to break the gas-tight seal between the two chambers. Thereafter, the gas will pressurize the expandable chamber 82 and further force the diaphragm and reciprocating plate downwardly against the opposing force of bias spring 91. Gas outlet passageway 94 is open to atmosphere via gas outlet port 92, so that the gas pressure in the chamber 82 is quickly relieved, thereby allowing the reciprocating plate and diaphragm to be forced upwardly by the spring to again close the diaphragm-collar seal. This alternating expansion and contraction of chamber 82 and concomitant reciprocation of plate 96 is repeated rapidly to reciprocate rod 81 and applicator 97 to achieve the percussive effect of the device. In the embodiment shown, openings 99 in the body of the device allow for the operator to more easily hold the device. Moreover, a needle valve may be incorporated to allow for adjustment of the rate of venting of gas from chamber 82, for varying the rate of plate reciprocation in cavity 95 as previously described.

Although the apparatus of the invention is shown and described as incorporating a flexible diaphragm, other gas sealing means including O-rings and the like may be substituted to achieve equivalent functioning. For example, an O-ring or the like may be secured to plate 96 to form a gas-tight seal between chamber 86 and cavity 95, as the plate reciprocates, without requiring a diaphragm. However, because of wear of the O-ring over periods of use, the embodiment shown may be preferred. Other modifications or embodiments of the devices disclosed herein as well as advantages thereof within the purview of the invention may be evident to those skilled in the art.

I claim:

1. A percussor comprising an oscillating assembly comprising a reciprocating plate and an applicator cooperating therewith for directing reciprocating motion from said plate to a user, a rigid housing member having therein first and second gas chambers, and first gas sealing means between said gas chambers, second gas sealing means cooperating with said reciprocating plate to prevent gas leakage from said first chamber through said oscillating assembly, gas inlet means for introducing gas into said first gas chamber at a pressure therein sufficient to overcome said first gas sealing means whereby gas enters said second gas chamber and causes movement of said oscillating assembly in a first direction of said reciprocating motion, gas outlet means for venting gas from said second gas chamber whereby pressure therein is reduced causing movement of said oscillating assembly in a second direction of said reciprocating motion, and biasing means urging said first gas sealing member to form a gas seal between said first and second gas chambers.

2. The percussor of claim 1 wherein said first gas sealing member comprises and O-ring and said second gas sealing means comprises a flexible diaphragm having a first surface exposed to said first gas chamber, and abutting said plate.

3. A percussor as claimed in claim 1 wherein the gas outlet means includes a gas outlet passage-way communicating with the second chamber, and means for adjusting the flow rate of gas through the gas outlet passageway.

4. A percussor of claim 1 wherein the applicator means comprises a fluid containing chamber and a flexible outer cover therefor whereby percussions from said reciprocating plate are directed through the fluid and cover.

5. A percussor as claimed in claim 1 wherein said gas inlet means includes a gas inlet passageway and a gas sealing valve therein for selectively opening and closing said gas inlet passageway.

6. A percussor as claimed in claim 1 wherein the gas inlet means includes a gas inlet passageway and means for adjusting the flow of gas through the gas inlet passageway.

7. The percussor of claim 2 wherein said oscillating assembly includes a plunger, and wherein said diaphragm is secured between said plate and said plunger.

8. The percussor of claim 1 wherein said first gas sealing member is secured to said reciprocating plate.

* * * * *